US008948435B2

(12) United States Patent
Oosato et al.

(10) Patent No.: US 8,948,435 B2
(45) **Date of Patent: *Feb. 3, 2015**

(54) DRIVER UNIT AND EARPHONE DEVICE

(75) Inventors: Yuusuke Oosato, Tokyo (JP); Koji Nageno, Tokyo (JP); Takahiro Suzuki, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/561,880

(22) Filed: Jul. 30, 2012

(65) Prior Publication Data

US 2013/0058508 A1 Mar. 7, 2013

(30) Foreign Application Priority Data

Sep. 5, 2011 (JP) ..... 2011-192687

(51) Int. Cl.

| | |
|---|---|
| ***H04R 25/00*** | (2006.01) |
| ***H04R 1/10*** | (2006.01) |
| *H04R 1/26* | (2006.01) |
| *H04R 1/28* | (2006.01) |
| *H04R 11/02* | (2006.01) |

(52) U.S. Cl.

CPC ..... *H04R 1/1075* (2013.01); *H04R 1/1016* (2013.01); *H04R 1/26* (2013.01); *H04R 1/2849* (2013.01); *H04R 11/02* (2013.01); *H04R 2205/022* (2013.01)

USPC ..... 381/380; 381/328; 381/418

(58) Field of Classification Search

CPC .... H04R 11/02; H04R 1/1016; H04R 1/1075; H04R 1/26; H04R 1/2849; H04R 2205/022

USPC ..... 381/322, 328, 162, 182, 186, 380, 386, 381/417, 418, 309, 370

See application file for complete search history.

(56) References Cited

U.S. PATENT DOCUMENTS

| | | | | |
|---|---|---|---|---|
| 4,272,654 | A * | 6/1981 | Carlson | 310/20 |
| 7,634,099 | B2 * | 12/2009 | Harvey et al. | 381/380 |
| 8,135,163 | B2 * | 3/2012 | Blanchard et al. | 381/418 |
| 8,526,659 | B2 * | 9/2013 | Nageno et al. | 381/380 |
| 2007/0053540 | A1 | 3/2007 | Harvey | |
| 2008/0063223 | A1 * | 3/2008 | van Halteren et al. | 381/182 |
| 2009/0060245 | A1 | 3/2009 | Blanchard et al. | |
| 2009/0220113 | A1 | 9/2009 | Tiscareno | |

FOREIGN PATENT DOCUMENTS

JP 2011-040933 A 2/2011

* cited by examiner

*Primary Examiner* — Huyen D Le
(74) *Attorney, Agent, or Firm* — Sony Corporation

(57) ABSTRACT

Provided is a driver unit including an acoustic conversion unit; and a housing body in which the acoustic conversion unit is housed, and in which an opening is formed. The acoustic conversion unit includes a pair of magnets arranged to face each other, a coil to which an input signal is supplied, an armature at which a vibrating part passing through the coil and arranged between the pair of magnets is formed, and a vibrating plate connected to the armature. A size of the opening is larger than 40 μm and smaller than 100 μm.

11 Claims, 14 Drawing Sheets

32

A

B

DRIVER UNIT AND EARPHONE DEVICE

BACKGROUND

The present disclosure relates to, for example, a balanced armature driver unit and an earphone device.

As a system of a driver unit for earphone device, a balanced armature driver unit has been known. In the balanced armature driver unit, an armature (vibrator) vibrates in response to an electric signal supplied to a coil. By the vibration of the armature, a vibrating plate connected to the armature vibrates, whereby a sound is generated. The sound is emitted outside the driver unit and is introduced to the external acoustic meatus of the user using the earphone device via a sound conductive tube. The sound then reaches the tympanum of the user via the external acoustic meatus, so that the sound is perceived by the user using the earphone device. JP 2011-040933A discloses an earphone device which includes a balanced armature driver unit for low frequency range and a balanced armature driver unit for middle and high frequency ranges.

SUMMARY

While the balanced armature driver unit is easy to downsize, the vibrating plate decreases in size and the low frequency range tends to lack sensitivity. To improve this point, for example, an LPF (Low Pass Filter) including a capacitor and an inductor is provided to the driver unit, and is applied to an input signal. The input signal to which the LPF has been applied is added to the original input signal, whereby a signal with an emphasized low frequency range is reproduced.

However, providing the LPF to the driver unit may lead to a problem in which the driver unit as a whole increases in size. This leads to a problem in which an earphone device equipped with the driver unit increases in size. Further, the technology disclosed in JP 2011-040933A requires that driver units having different shapes be respectively formed as driver units for the middle and high frequency ranges and for a low frequency range. Therefore, there is a problem that manufacturing of the driver units becomes costly.

Accordingly, the present disclosure provides a driver unit which is capable of reproducing a sound of a low frequency range without providing an LPF and the like.

According to an embodiment of the present disclosure, there is provided a driver unit including an acoustic conversion unit, and a housing body in which the acoustic conversion unit is housed, and in which an opening is formed. The acoustic conversion unit includes a pair of magnets arranged to face each other, a coil to which an input signal is supplied, an armature at which a vibrating part passing through the coil and arranged between the pair of magnets is formed, and a vibrating plate connected to the armature. A size of the opening is larger than 40 μm and smaller than 100 μm.

According to another embodiment of the present disclosure, there is provided an earphone device including at least two or more driver units being supported by a supporting part in an inner space formed by a housing. Each of the driver units includes an acoustic conversion unit, and a housing body in which the acoustic conversion unit is housed, and in which an opening is formed. The acoustic conversion unit includes a pair of magnets arranged to face each other, a coil to which an electrical signal is supplied, an armature at which a vibrating part passing through the coil and arranged between the pair of magnets is formed, and a vibrating plate connected to the armature. A size of the opening of one of the driver units is larger than 40 μm and smaller than 100 μm.

According to at least one embodiment, a sound of a low frequency range can be reproduced from a driver unit without providing an LPF and the like.

DETAILED DESCRIPTION OF THE EMBODIMENTS

Figure 1:
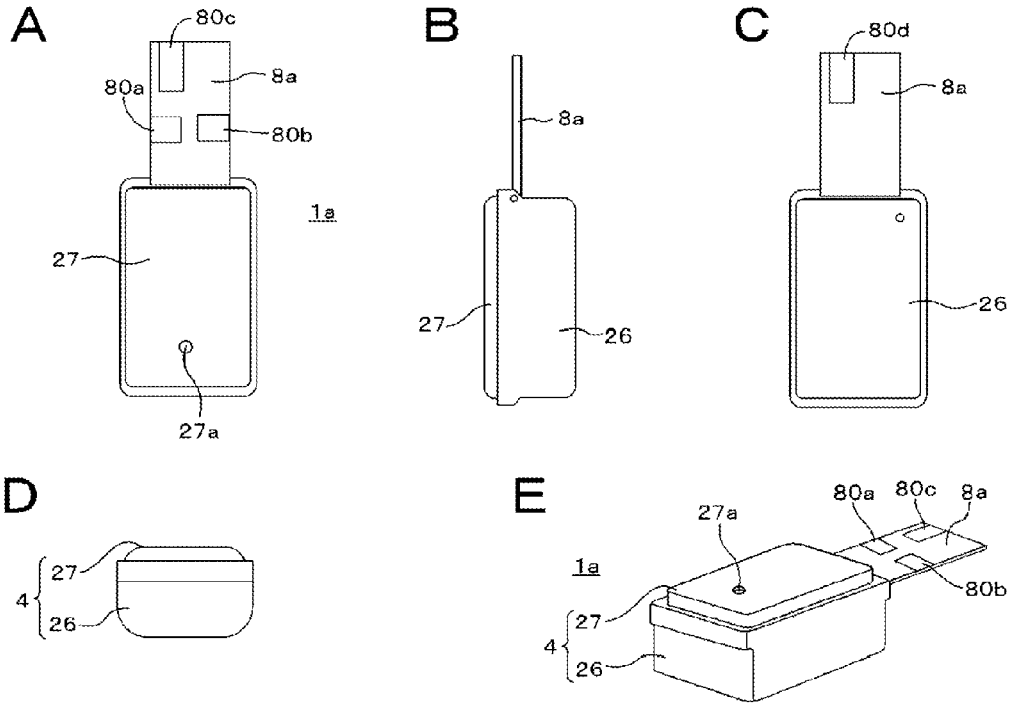
FIGS. 1A to 1E are a plan view and the like each showing an example of an appearance of a driver unit for woofer.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Hereinafter, preferred embodiments and modifications of the present disclosure will be described with reference to the appended drawings. The description will be given in the following order.

<1. First Embodiment>

<2. Modifications>

Note that, the present disclosure is not limited to the embodiments and the modifications described below.

1. First Embodiment

Configuration of Driver Unit for Woofer

A driver unit exemplarily described below is a so-called "balanced armature driver unit". First, the driver unit for woofer will be described.

FIGS. 1A to 1E respectively show a plan view, a side view, a bottom view, a front view, and a perspective view of a driver unit 1*a* for woofer. The driver unit 1*a* has a housing body 4 made of resin and the like. The housing body 4 is, for example, formed of a case body 26 and a cover body 27, and an acoustic conversion unit described later is housed inside the housing body 4. The size (volume) of the housing body 4 is set so that the housing body 4 can be housed in an inner space of an earphone device.

A circuit substrate 8*a* formed of, for example, a flexible substrate is led out of the housing body 4. On one surface of the circuit substrate 8*a*, a conductive pattern 80*a*, a conductive pattern 80*b*, and a conductive pattern 80*c* are formed at predetermined intervals. To ensure an insulation distance between the conductive patterns, a conductive pattern 80*d* may be formed on the other surface of the circuit substrate 8*a*. The number of the conductive patterns to be formed and the positions at which the conductive patterns are formed can be properly changed. An input signal is supplied to the driver unit 1*a* via the conductive patterns.

A roughly circular opening 27*a* is formed in the cover body 27. The opening 27*a* is, for example, formed in a surface which faces a vibrating surface of a vibrating plate unit 3 inside the housing body 4 described later. The opening 27*a* is formed at a position which is deviated from the center of the cover body 27 in a longitudinal direction. Note that the position at which the opening 27*a* is formed is an example, and is not limited to the example shown in the drawing. For example, the opening 27*a* can be formed at another position on the cover body 27 or in the case body 26. Further, the opening 27*a* is not limited to the circle, and other forms such as a rectangle can be adopted.

The opening 27*a* is, for example, formed by drilling processing with a high-power volatile laser. As the laser, a carbon dioxide laser, an ultraviolet YAG laser, or the like can be used. By the drilling processing using laser, the opening 27*a* can be precisely formed. The diameter of the opening 27*a* is, for example, set to be larger than 40 μm (micrometer) and smaller than 100 μm. An acoustic inertance component of the opening 27*a* functions like a kind of LPF similar to an inductor. A sound generated by the acoustic conversion unit of the driver unit 1*a* is emitted from the opening 27*a*.

Figure 2:
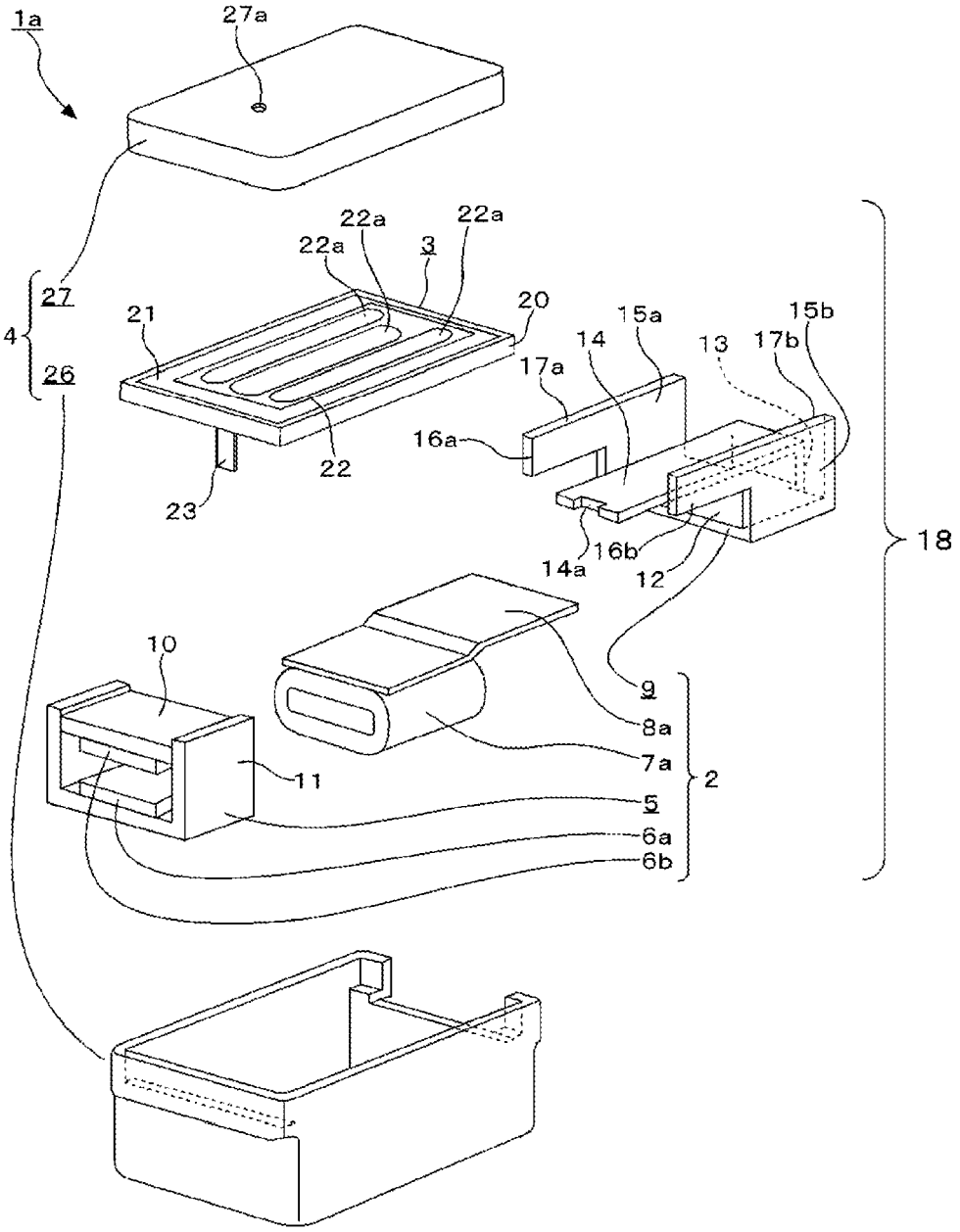
FIG. 2 is an exploded perspective view showing an example of a configuration of the driver unit for woofer.
Figure 3:
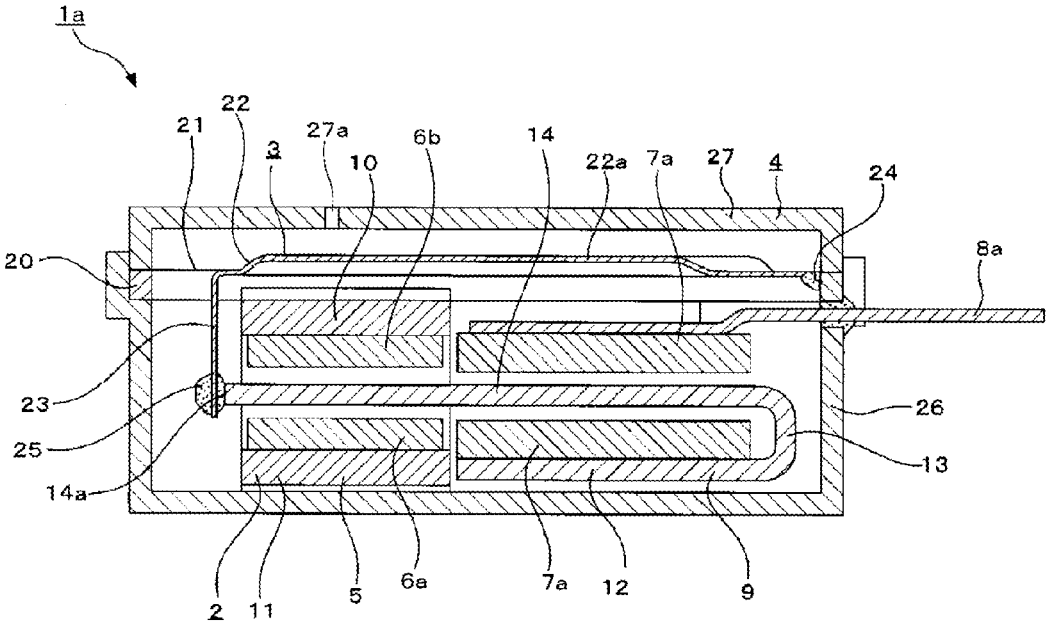
FIG. 3 is a cross-sectional view showing an example of a cross-section of the driver unit for woofer.

FIG. 2 shows an exploded perspective view of the driver unit 1*a*, and FIG. 3 shows a cross-sectional view of the driver unit 1*a*. Note that, in the following description of the driver unit 1*a*, the side shown by the front view of FIG. 1D is defined to be front, the side to which the circuit substrate 8*a* is led is defined to be rear, and the description of "front and rear", "up and down", and "right and left" will be properly used. However, the description of "front and rear", "up and down", and "right and left" is used merely for convenience, and the present disclosure is not limited to the described directions.

As shown in FIG. 2, the driver unit 1*a* includes the housing body 4 in which an acoustic conversion unit 18 formed of a driving unit 2 and the vibrating plate unit 3 is housed. The driving unit 2 includes a yoke 5, a pair of magnets 6*a* and 6*b*, a coil 7*a*, the circuit substrate 8*a*, and an armature 9.

The yoke 5 is formed of a plate-like first member 10 facing up and down direction and an angular U-shaped second member 11 opening upward. Right and left end surfaces of the member 10 are attached to inner surfaces in the vicinity of the opening part of the member 11 by adhesion, for example. With the members 10 and 11, the yoke 5 is formed in a square cylindrical shape having a through hole in the front-back direction.

The pair of magnets 6*a* and 6*b* is attached inside the yoke 5. The magnets 6*a* and 6*b* are separately arranged to face each other, and the facing sides have different polarities. The magnet 6*a* is attached to an under surface of the member 10, and the magnet 6*b* is attached to an upper surface of a bottom surface part of the member 11.

The coil 7*a* is formed in a cylindrical shape whose axis is in the front-back direction, and is also formed in a long-hole shape when seen in the front-back direction. The coil 7*a* is regularly wound, and upper and under surfaces thereof are formed flat. The circuit substrate 8*a* is attached to the upper surface of the coil 7*a*. The length of the circuit substrate 8*a* in the front-back direction is set to be longer than the length of the upper surface of the coil 7*a* in the front-back direction, and a part of the circuit substrate 8*a* is attached to the upper surface of the coil 7*a*.

Both end parts of the coil 7*a* are respectively connected to predetermined terminals at two positions of the circuit substrate 8*a* inside the housing body 4, thereby forming an electric circuit for supplying an input signal to the coil 7*a*. The predetermined terminals are, for example, electrically connected to the conductive patterns 80*a* and 80*b* via a through hole formed in the circuit substrate 8*a*. Note that, since the coil 7*a* is regularly wound and the upper surface thereof is formed flat, satisfactory joint condition between the coil 7*a* and the circuit substrate 8*a* can be ensured.

The armature 9 is made of magnetic metal material, for example, and each part is integrally formed. The armature 9 is formed of a plate-like coil attaching part 12 facing the up and down direction, a connection part 13 rising upward from the vicinity of the center of an rear end of the coil attaching part 12, a vibrating part 14 extending forward from an upper end portion of the connection part 13, side wall parts 15*a* and 15*b* respectively rising from both ends of the coil attaching part 12, a part to be fixed 16*a* extending forward from an approximately upper half portion of the side wall part 15*a*, and a part to be fixed 16*b* extending forward from an approximately upper half portion of the side wall part 15*b*.

A front end of the vibrating part 14 extending from the connection part 13 is positioned forward of a front end of the coil attaching part 12. The width of the vibrating part 14 in the right and left direction is set so that the vibrating part 14 can pass through the coil 7*a*. At the front end of the vibrating part 14, a recess for connection 14*a* recessed backward is formed.

An upper surface of the side wall part 15*a* and an upper surface of the part to be fixed 16*a* form the same plane. Also, an upper surface of the side wall part 15*b* and an upper surface of the part to be fixed 16*b* form the same plane. The respective planes separately arranged right and left function as fixing surfaces 17*a* and 17*b*.

The vibrating part 14 passes through the coil 7*a*, and the coil 7*a* is attached to an upper surface of the coil attaching part 12 by adhesion, for example. Since the coil 7*a* is regularly wound and the under surface thereof is formed flat, the coil 7*a* can be stably and surely attached to the coil attaching part 12. As shown in FIG. 3, in a state where the coil 7*a* is attached to the coil attaching part 12, the vibrating part 14 passes through the coil 7*a*, and a part of the vibrating part 14 protrudes forward.

In the driver unit 1*a*, the coil attaching part 12 to which the coil 7*a* is attached and the vibrating part 14 passing through the coil 7*a* are provided to the armature 9. Therefore, the position of the vibrating part 14 with respect to the coil 7*a* can be ensured with high precision, whereby accuracy of the positioning of the vibrating part 14 with respect to the coil 7*a* can be improved.

In a state where the coil 7*a* is attached to the coil attaching part 12, the armature 9 has the parts to be fixed 16*a* and 16*b* which are respectively fixed to outer surfaces of side surface parts of the yoke 5. The armature 9 is, for example, fixed to the yoke 5 by adhesion or welding. In the state where the armature 9 is fixed to the yoke 5, an upper surface of a side wall of the yoke 5 is positioned slightly higher than the fixing surfaces 17*a* and 17*b* of the armature 9. Also, the recess for connection 14*a* is positioned slightly forward of front end parts of the magnets 6*a* and 6*b*. Note that at least the vibrating part of the armature to be magnetized may just be made of metal material.

The vibrating plate unit 3 includes a holding frame 20, a resin film 21, a vibrating plate 22, and a beam part 23. The holding frame 20 is, for example, made of metal material, and is formed in a longitudinal frame shape in the front-back direction. The width of the holding frame 20 in the right and left direction is approximately the same as the width of the armature 9 in the right and left direction. The resin film 21 is approximately the same as an external form of the holding frame 20 in size, and is, for example, adhered to an upper surface of the holding frame 20 by adhesion or the like so as to block up an opening of the holding frame 20.

The vibrating plate 22 is formed of a thin component made of metal material, and an external form thereof is formed in a rectangular form slightly smaller than an inner form of the holding frame 20. The vibrating plate 22 is, for example, made of aluminum or stainless steel. Three reinforcing ribs 22*a*, 22*a*, and 22*a* are, for example, provided to the vibrating plate 22, each of the reinforcing ribs 22*a* being arranged apart from each other. The number of the reinforcing ribs 22*a* and the positions at which the reinforcing ribs 22*a* are provided can be properly changed. Each of the reinforcing ribs 22*a* is formed in a shape pushed upward. The vibrating plate 22 is adhered to an upper surface of the resin film 21.

A rear end of the vibrating plate 22 is positioned slightly forward of an inner surface at a rear end part of the holding frame 20, and a gap is formed between the rear end of the vibrating plate 22 and the inner surface at the rear end part of the holding frame 20. As shown in FIG. 3, an adhesive 24 is applied to fill the gap. As the adhesive 24, an acrylic non-curing type adhesive or an acrylic ultraviolet curing type adhesive can be used.

The vibrating plate 22 and the holding frame 20 are connected via the adhesive 24 and the resin film 21. Note that the adhesive 24 fills the gap and also extends to the other side of the surface which is adhered to the resin film 21 of the vibrating plate 22. That is, the vibrating plate 22 is supported to the holding frame 20 by the resin film 21, and the adhesive 24 functions as a reinforcing member for reinforcing this state.

The beam part 23 is, for example, integrally formed with the vibrating plate 22, and is formed in such a way that a part of the vibrating plate 22 is bent downward. The beam part 23 is, for example, formed in a narrow plate-like shape extending in the up and down direction.

The vibrating plate unit 3 is attached to the driving unit 2. An under surface of the holding frame 20 of the vibrating plate unit 3 is fixed to the fixing surfaces 17*a* and 17*b* of the armature 9. For example, the vibrating plate unit 3 is fixed to the driving unit 2 by adhesion or laser welding. When the vibrating plate unit 3 is fixed to the driving unit 2, a lower end part of the beam part 23 is attached to the vibrating part 14 of the armature 9. For example, after the lower end part of the beam part 23 is inserted into the recess for connection 14*a* at a front end of the vibrating part 14, an adhesive 25 is applied, whereby the lower end part of the beam part 23 is adhered to the vibrating part 14.

The beam part 23 is integrally formed with the vibrating plate 22. Therefore, by simply attaching the lower end part of the beam part 23 to the vibrating plate 14, the vibrating plate 22 and the armature 9 can be connected via the beam part 23, whereby a structure in which vibration of the vibrating part 14 is communicated to the vibrating plate 22 can be formed.

As described with reference to FIG. 1, the housing body 4 is formed of the box-like case body 26 having the upper surface opening upward and the recess at one of the side surfaces, and the shallow box-like cover body 27 having the under surface opening downward. For example, the opening 27*a* is formed in the upper surface of the cover body 27. In this example, the surface in which the opening 27*a* is formed is the surface facing the vibrating surface of the vibrating plate 22 housed inside the housing body 4. The surface in which the opening 27*a* is formed can be properly changed. As shown in FIG. 3, a sound generated by the vibration of the vibrating plate 22 is emitted to a space above the vibrating surface, so that the sound is emitted outside the housing body 4 from the opening 27*a*.

A recess is formed in the case body 26, and the circuit substrate 8*a* extends through the recess. For example, in the vicinity of the recess, an adhesive may be applied so that a part of the circuit substrate 8*a* is fixed to the housing body 4.

[Operation of Driver Unit for Woofer]

An example of operation of the driver unit 1*a* having the above-described configuration will be described. Positive and negative electrical signals as input signals are supplied to the circuit substrate 8*a* via a cable (not shown). The input signal is then supplied to the coil 7*a* via the circuit substrate 8*a*.

In response to the input signal supplied to the coil 7*a*, the vibrating part 14 of the armature 9 vibrates. The vibration of the vibrating part 14 is transmitted to the vibrating plate 22 via the beam part 23, so that the vibrating plate 22 vibrates. A sound is generated by the vibration of the vibrating plate 22. The generated sound is emitted to a space above the vibrating surface. Then, the sound emitted to the space above the vibrating surface is emitted outside the driver unit 1*a* via the opening 27*a*.

[Configuration of Full-Range Driver Unit]

Next, a full-range driver unit will be described. FIGS. 4A to 4E respectively show a plan view, a side view, a bottom view, a front view, and a perspective view of a full-range driver unit 1*b*. FIG. 5 shows an exploded perspective view of the driver unit 1*b*, and FIG. 6 shows a cross-sectional view of the driver unit 1*b*. Note that, in the driver unit 1*b*, elements that have substantially the same configuration as those of the driver unit 1*a* for woofer are denoted with the same reference signs, and repeated explanation is omitted.

Figure 4:
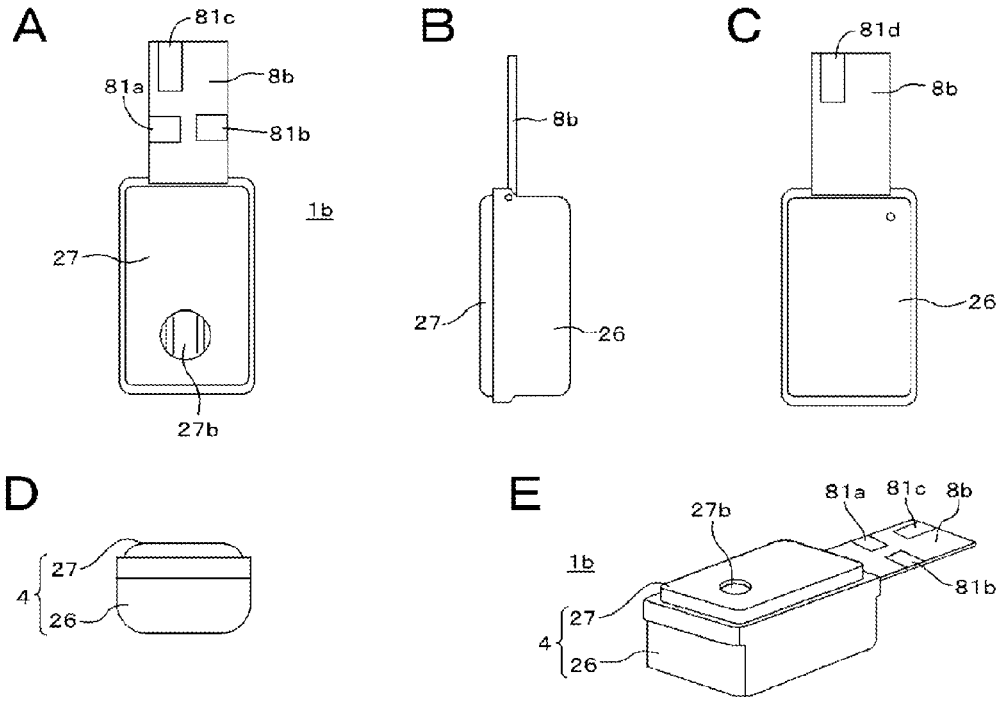
FIGS. 4A to 4E are a plan view and the like each showing an example of an appearance of a full-range driver unit.
Figure 5:
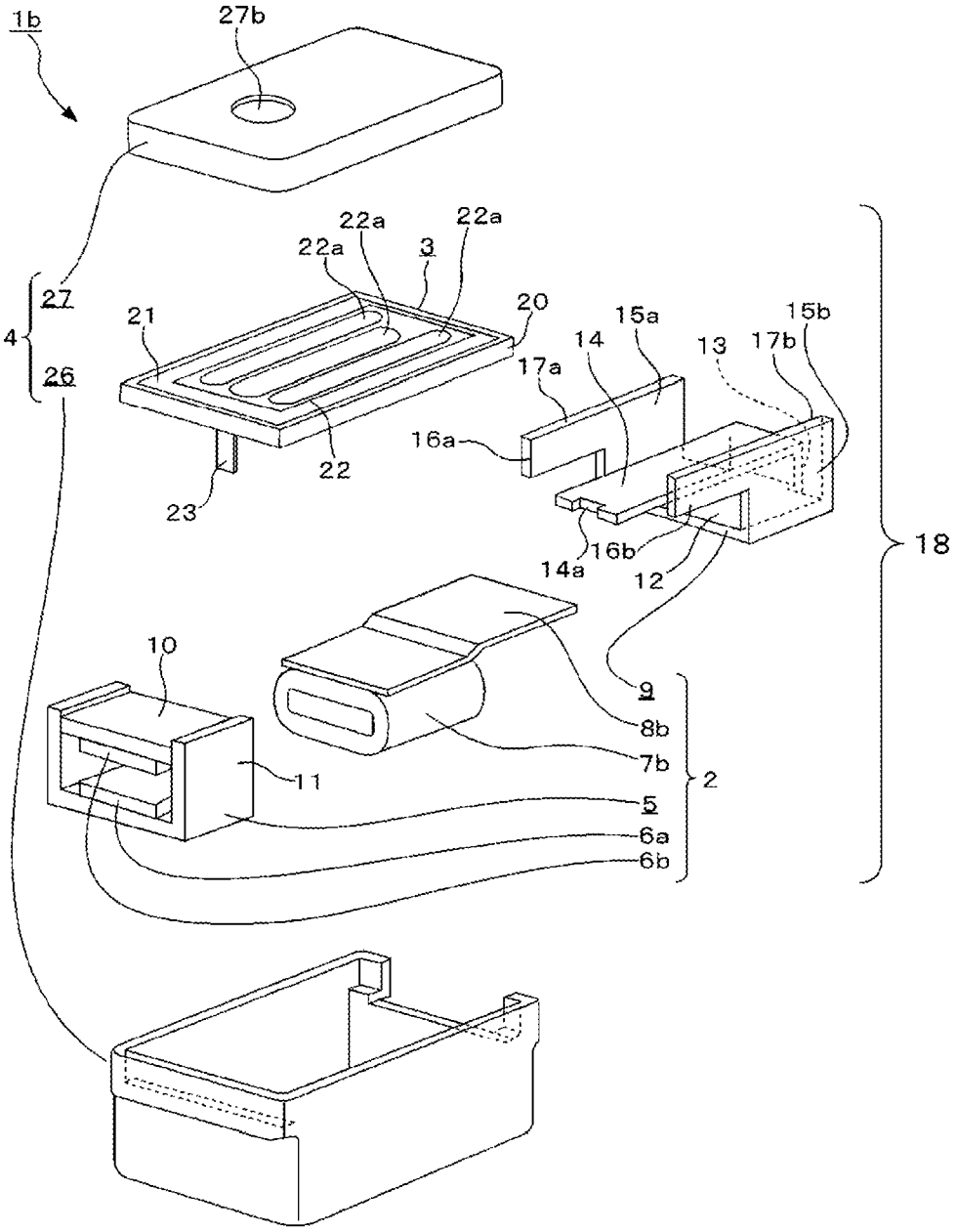
FIG. 5 is an exploded perspective view showing an example of a configuration of the full-range driver unit.
Figure 6:
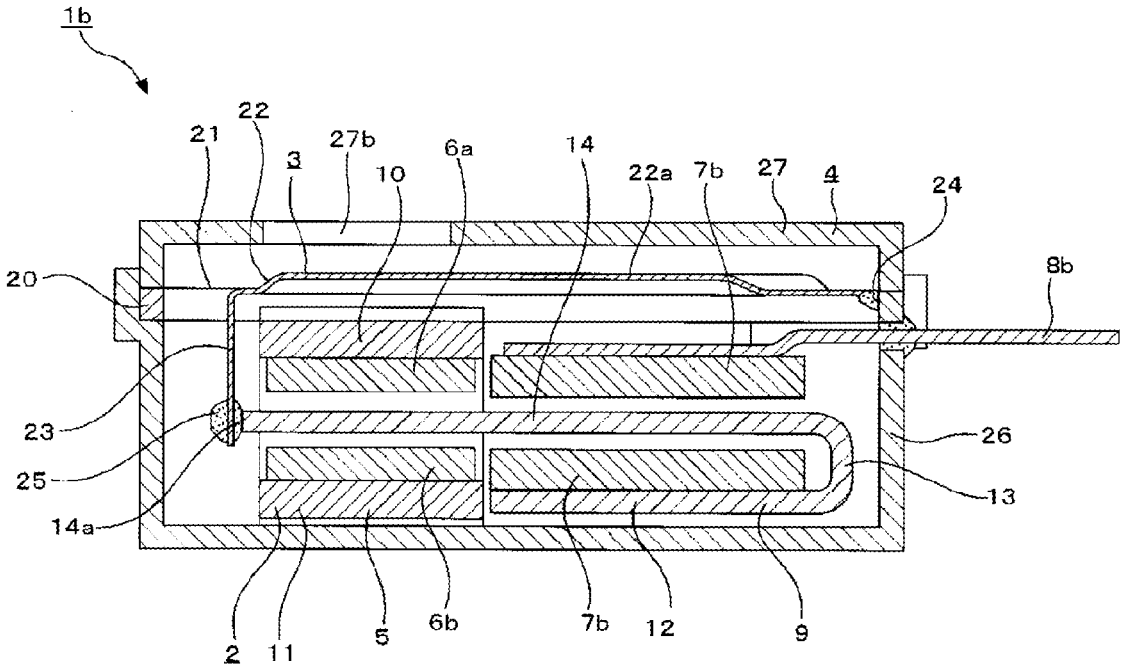
FIG. 6 is a cross-sectional view showing an example of a cross-section of the full-range driver unit.

As exemplarily shown in FIGS. 4 to 6, the driver unit 1*b* has substantially the same configuration as the driver unit 1*a*. The diameter of an opening 27*b* formed in a cover body 27 of the driver unit 1*b* differs from that of the opening 27*a*. The diameter of the opening 27*b* is, for example, 1.5 mm (millimeter).

The configuration of the driver unit 1*b* can be made different from that of the driver unit 1*a*. However, by simply changing the diameter of the opening, the driver unit can function as either a driver unit for woofer or a full range driver unit. That is, by properly setting an output of a laser, openings having different diameters can be formed, whereby the driver unit for woofer and the full range driver unit can be easily manufactured. It is not necessary to change the shape or the size of the housing body or to change the configuration of the acoustic conversion unit. Therefore, the cost for manufacturing the driver unit can be reduced and manufacturing efficiency can be improved.

Note that, for the convenience of later description, a circuit substrate of the driver unit 1*b* is represented as a circuit substrate 8*b*. Conductive patterns formed on the circuit substrate 8*b* are represented as a conductive pattern 81*a*, a conductive pattern 81*b*, a conductive pattern 81*c*, and a conductive pattern 81*d*. A coil 7*b* provided in the driver unit 1*b* has substantially the same shape as the coil 7*a*. Both ends of the coil 7*b* are connected to predetermined terminals at two positions on the circuit substrate 8*b*. The predetermined terminals at the two positions are electrically connected to the conductive patterns 81*a* and 81*b*, respectively.

[Size of Opening]

A reason why the driver unit 1*a* functions as a driver unit for woofer by causing the size of the opening 27*a* of the driver unit 1*a* to be narrow and small will be described.

A sound conductor path of a sound generated by vibration of the vibrating plate 22 is narrowed by the opening 27*a*. An (acoustic) inertance component by the opening 27*a* functions as a kind of LPF similar to a series inductor. Inertance is viscosity when air flows through a narrow tube, and is inversely proportional to a cross-section and is proportional to a length. Here, the opening 27*a* is likened to a tube, and where the diameter of the opening 27*a* is A (μm) and the length is L (mm), the cross-section S of the opening 27*a* is obtained by the following formula (1).

$$S=(A/2)^2*\pi \qquad \text{Formula (1)}$$

(In Formula (1), "/" means division, and "π" means the circular constant.)

The inertance component is obtained by the following formula (2).

$$Ma=4\rho L/3S \qquad \text{Formula (2)}$$

Unit: (kg/m$^4$)

(In Formula (2), "ρ" means density of gas.)

Here, the length L of the opening 27*a* of the driver unit 1*a* corresponds to the thickness of the case body 26. Where L is 0.2 mm, ρ is the density of air of 1.29 (kg/m$^3$), and these values are substituted into Formula (2), the following table 1 can be obtained as the inertance with respect to the diameter A.

TABLE 1

| Diameter A (μm) | Ma (kg/m$^4$) * 10$^3$ |
|---|---|
| 100 | 43 |
| 80 | 68 |
| 70 | 89 |
| 60 | 121 |
| 50 | 175 |
| 40 | 273 |

As shown in Table 1, the smaller the diameter A is, the larger load occurs due to the inertance.

Figure 7:
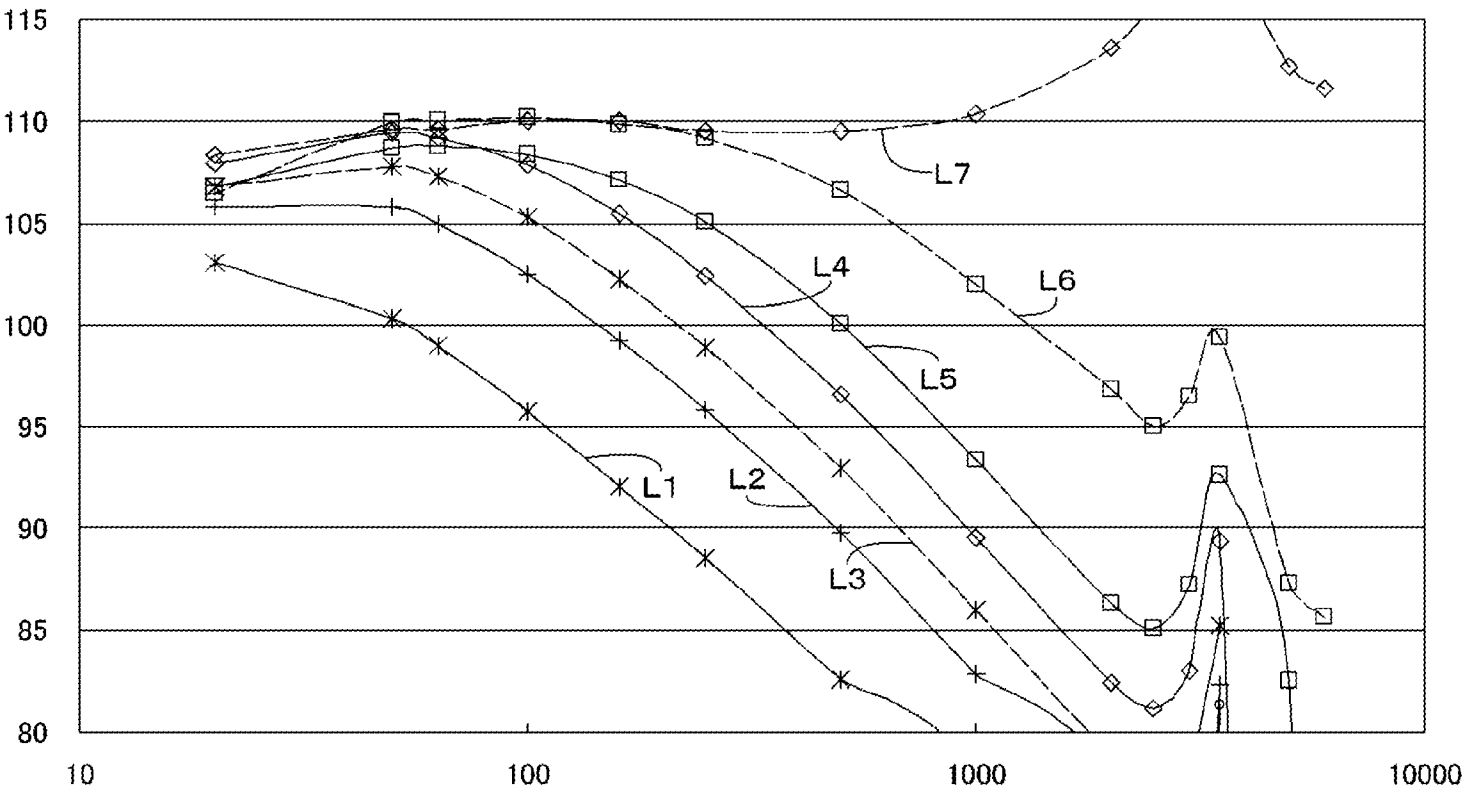
FIG. 7 is a diagram illustrating an example of a frequency characteristic of a sound emitted from the driver unit.

FIG. 7 shows an example of a frequency characteristic of a sound that is emitted from the opening when the value of the diameter A is changed. In the graph, the vertical axis corresponds to sound pressure level (dB), and the horizontal axis corresponds to frequency (Hz). In the graph, a line L1 shows the characteristic when the diameter of the opening is 40 μm, a line L2 shows the characteristic when the diameter of the opening is 50 μm, a line L3 shows the characteristic when the diameter of the opening is 60 μm, a line L4 shows the characteristic when the diameter of the opening is 70 μm, a line L5 shows the characteristic when the diameter of the opening is 80 μm, a line L6 shows the characteristic when the diameter of the opening is 100 μm, and a line L7 shows the characteristic when the diameter of the opening is 150 μm.

As shown in FIG. 7, as the diameter A is smaller, the load due to the inertance becomes larger and the cut-off frequency becomes lower. Here, a range exhibited by the characteristic of the diameter A of 100 μm corresponds to the midrange. Therefore, to cause a driver unit to function as the driver unit for woofer, it is preferable that the diameter A of the opening 27*a* be smaller than 100 μm. Meanwhile, making the diameter A too small may cause deterioration of sensitivity. When the diameter A is smaller than 40 μm (for example, 40 μm or less), the sensitivity is lowered. Therefore, as a driver unit which shows the characteristic of woofer, it is preferable that the diameter A of the opening 27*a* be larger than 40 μm and be smaller than 100 μm. By simply changing the diameter of the opening, a driver unit having a desired characteristic can be configured.

As shown in the line L7 in FIG. 7, where the diameter A is about 1.5 mm, the driver unit exhibits a full range characteristic. Therefore, to cause a driver unit to function as the full-range driver unit, the diameter A may be just set to be about 1.5 mm, for example.

Note that, a driver unit for tweeter (hereinafter, properly referred to as driver unit 1*c*) can be configured by using a network. The driver unit 1*c* has, for example, substantially the same configuration as the full-range driver unit 1*b*, and a diameter of an opening 27*c* provided to the driver unit 1*c* is, for example, about 1.5 mm. At a front stage of the driver unit 1*c*, an HPF (High Pass Filter) as the network is provided. The HPF is, for example, configured from a capacitor.

An input signal whose low frequency range component has been cut by the HPF is provided to the driver unit 1*c*. The driver unit 1*c* generates a sound of a high frequency range in response to the input signal. The sound of the high frequency range is emitted from the opening 27*c* of the driver unit 1*c*. Note that, the HPF can be applied to the emitted sound from the driver unit 1*c*. By using the network, a driver unit for tweeter can be configured.

A network configured from an LPF can be provided to the driver unit 1*a*. By using the network configured from the LPF in addition to causing the opening 27*a* to be narrow and small, more precise filtering can be possible, whereby a sound of a low frequency range emitted from the opening 27*a* can be strengthened.

[Earphone Device]

An example of an earphone device to which the driver unit 1*a* for woofer can be applied will be described. The earphone device includes a housing, and at least two or more driver units are supported by a supporting part in an inner space formed by the housing. For example, a driver unit for woofer and a full-range driver unit are supported by the supporting part.

Figure 8:
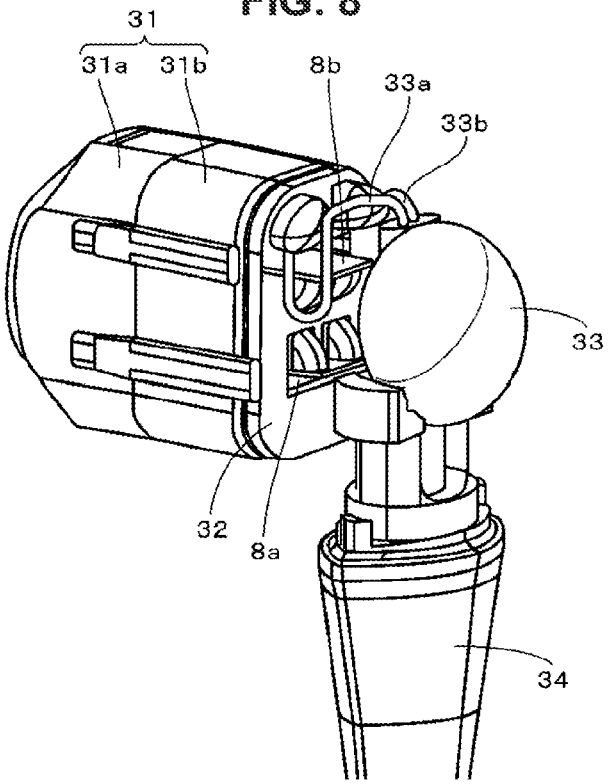
FIG. 8 is a perspective view showing an example of a configuration inside a housing of an earphone device.

FIG. 8 shows an example of a configuration inside the housing of an earphone device 30. An inner housing 31 as an example of the supporting part is, for example, formed by combining a front inner housing 31*a* and a rear inner housing 31*b*. At the front inner housing 31*a*, for example, insertion openings for inserting two or more driver units are formed in the direction of layering. In this example, two insertion openings are formed in the front inner housing 31*a*.

To the insertion openings of the front inner housing 31*a*, the driver units 1*a* and 1*b* are respectively inserted. After the insertion, the front inner housing 31*a* and the rear inner housing 31*b* are combined. When the front inner housing 31*a* and the rear inner housing 31*b* are combined, an inner surface of the rear inner housing 31*b* comes in contact with each driver unit. By the front inner housing 31*a* and the rear inner housing 31*b*, the driver units 1*a* and 1*b* are layered and supported. Note that a gap caused between the inner housing 31 and the driver unit 1*a* or the driver unit 1*b* can be filled with an adhesive so that the driver units 1*a* and 1*b* are firmly fixed.

As the material for the inner housing 31, for example, light and solid magnesium can be used. By using magnesium, the inner housing 31 can be thinner and downsized. By integrating the inner housing 31 and the driver units 1*a* and 1*b*, unnecessary vibration of each driver unit can be prevented.

At the rear inner housing 31*b*, openings are formed in the other end surface of the surface which is combined with the front inner housing 31*a*, the number of the openings corresponding to the number of the insertion openings. For example, two openings are formed in the rear inner housing 31*b*. The circuit substrate 8*a* of the driver unit 1*a* and the circuit substrate 8*b* of the driver unit 1*b* are respectively led out of the two openings. A relay substrate 32 is attached to an end surface of the side where the openings of the rear inner housing 31*b* are formed. Two openings are formed in the relay substrate 32, for example. The circuit substrates 8*a* and 8*b* led out of the rear inner housing 31*b* pass through the openings formed at the relay substrate 32 respectively.

A cord 33*a* extending from a core wire 33 is connected to the relay substrate 32. The cord 33*a* is fixed at a predetermined portion of the relay substrate 32 by soldering, for example. A signal of positive polarity is supplied via the cord 33*a*. Further, a cord 33*b* extending from the core wire 33 is connected to the relay substrate 32. The cord 33*b* is fixed at a predetermined portion of the relay substrate 32 by soldering, for example. A signal of negative polarity is supplied via the cord 33*b*. Note that, to protect the core wire 33, a cover 34 made of resin or the like can be provided.

Figure 9:
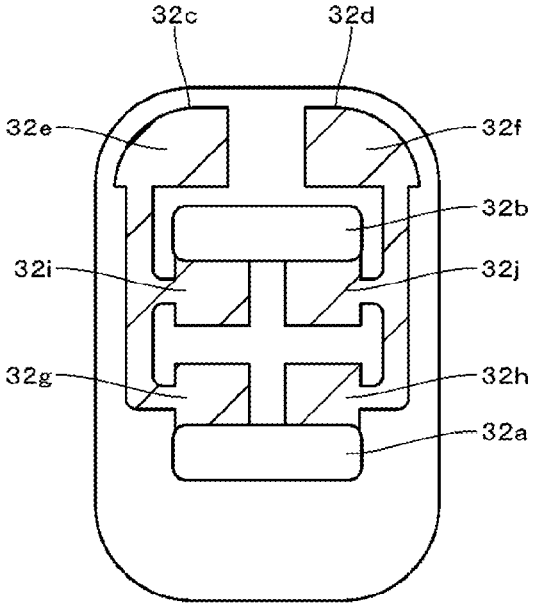
FIG. 9 is a schematic diagram showing an example of a configuration of a relay substrate.

FIG. 9 shows an example of a configuration of an end surface of the relay substrate 32. Openings 32*a* and 32*b* are formed in the relay substrate 32, for example. The circuit substrate 8*a* of the driver unit 1*a* passes through the opening 32*a*, and a part of the circuit substrate 8*a* extends therethrough. The circuit substrate 8*b* of the driver unit 1*b* passes through the opening 32*b*, and a part of the circuit substrate 8*b* extends therethrough.

Insulated conductive patterns 32*c* and 32*d* are formed on the relay substrate 32. In FIG. 9, the conductive patterns 32*c* and 32*d* are marked with slant lines. In the vicinity of an end part of the conductive pattern 32*c* shown by the reference number 32*e*, the cord 33*a* is fixed by soldering, for example. A positive input signal is supplied to the conductive pattern 32*c* via the cord 33*a*. In the vicinity of an end part of the conductive pattern 32*d* shown by the reference number 32*f*, the cord 33*b* is fixed by soldering, for example. A negative input signal is supplied to the conductive pattern 32*d* via the cord 33*b*.

The vicinity of the center of the conductive pattern 32*c* shown by the reference number 32*g* and the conductive pattern 80*a* of the circuit substrate 8*a* are fixed by soldering, for example. The vicinity of the center of the conductive pattern 32*c* shown by the reference number 32*h* and the conductive pattern 80*b* of the circuit substrate 8*a* are fixed by soldering, for example. By the soldering, positive and negative input signals are supplied to the circuit substrate 8*a*, and the input signals are supplied to the coil 7*a* connected to the circuit substrate 8*a*.

The vicinity of the center of the conductive pattern 32*c* shown by the reference number 32*i* and the conductive pattern 81*a* of the circuit substrate 8*b* are fixed by soldering, for example. The vicinity of the center of the conductive pattern 32*c* shown by the reference number 32*j* and the conductive pattern 81*b* of the circuit substrate 8*b* are fixed by soldering, for example. By the soldering, positive and negative input signals are supplied to the circuit substrate 8*b*, and the input signals are supplied to the coil 7*b* connected to the circuit substrate 8*b*. Note that, at the relay substrate 32, the positions where the openings and the conductive patterns are formed and the cords are fixed by soldering are one example, and the positions are not limited to the example.

Figure 10:
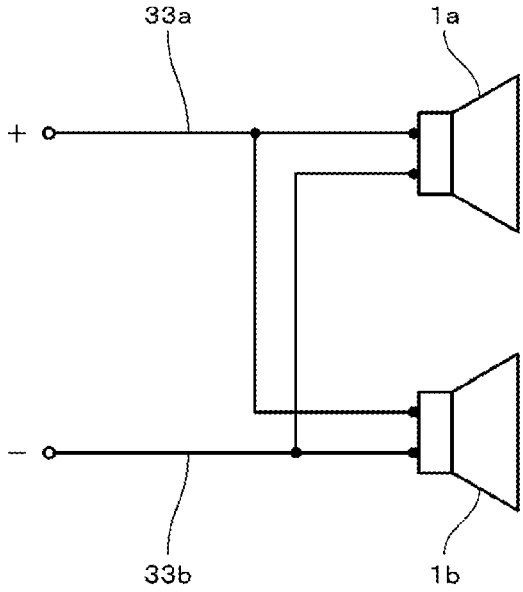
FIG. 10 is a connection diagram illustrating an embodiment of connection of the driver unit.

FIG. 10 shows an example of connection of a driver unit. In FIG. 10, the driver units 1*a* and 1*b* are respectively shown as speakers. Positive input signals supplied via the cord 33*a* are branched, and the branched positive input signals are respectively supplied to the driver units 1*a* and 1*b*. Negative input signals supplied via the cord 33*b* are branched, and the branched negative input signals are respectively supplied to the driver units 1*a* and 1*b*.

The positive and negative input signals are supplied to the coil 7*a* of the driver unit 1*a*. The positive and negative input signals are supplied to the coil 7*b* of the driver unit 1*b*. By the exemplary connection shown in FIG. 10, the driver units 1*a* and 1*b* are connected in parallel.

Figure 11:
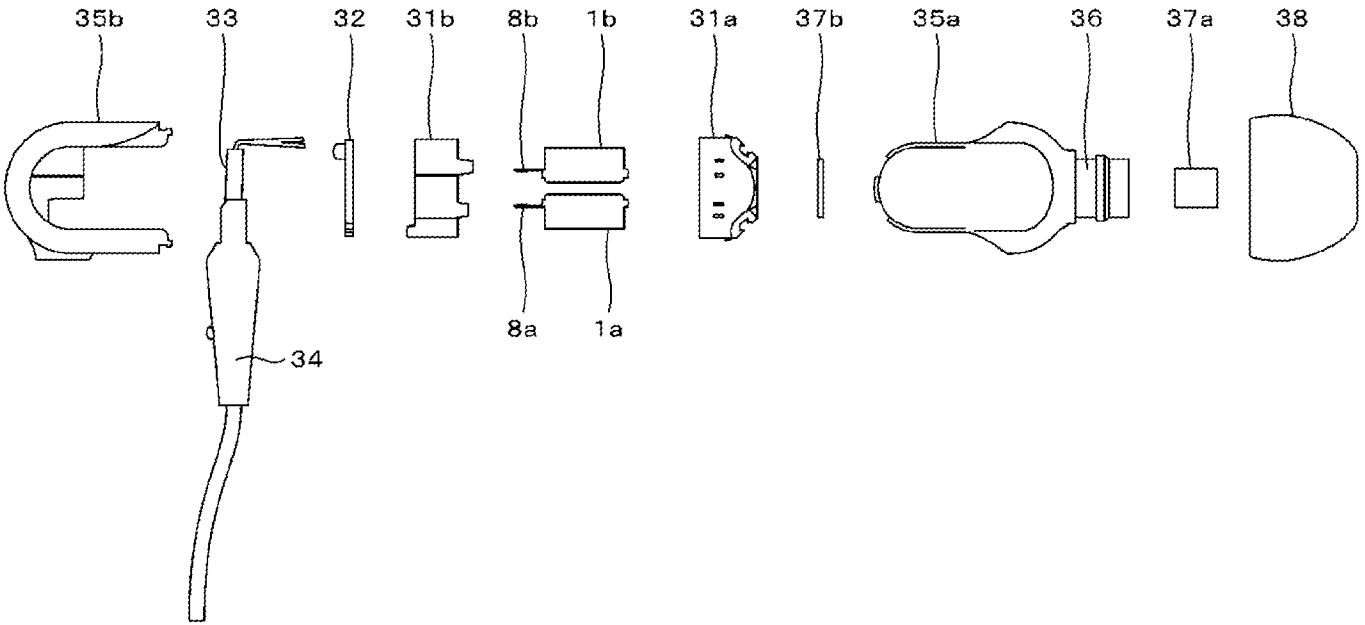
FIG. 11 is an exploded view illustrating an example of a configuration of the earphone device.

FIG. 11 shows an example of an exploded view of the earphone device 30. The earphone device 30 includes a housing 35 which is formed by combining a front housing 35*a* and a rear housing 35*b*. The housing 35 is made of metal such as stainless steel.

The front housing 35*a* and the rear housing 35*b* have spaces inside thereof respectively, which form a space inside the housing 35. A sound conductive tube 36 is integrally formed with the front housing 35*a*. An equalizer 37*a* for adjusting the balance of a predetermined range may be attached to the sound conductive tube 36. In the vicinity of the sound conductive tube 36 of the front housing 35*a*, an earpiece 38 is engaged. The earpiece 38 is made of elastic material such as silicon rubber or elastomer, and changes its shape in accordance with the shape of the external acoustic meatus of the user.

In the inner space formed by the housing 35, the front inner housing 31*a* is housed. The driver units 1*a* and 1*b* are inserted into the insertion openings of the front inner housing 31*a*. The rear inner housing 31*b* is combined with the front inner housing 31*a*, and the driver units 1*a* and 1*b* are supported by the inner housing 31. In the vicinity of an end surface of the front inner housing 31*a* at the side of the sound conductive tube 36, an equalizer 37*b* for adjusting the balance of a predetermined range can be attached.

The circuit substrate 8*a* of the driver unit 1*a* and the circuit substrate 8*b* of the driver unit 1*b* are respectively led out of the openings of the rear inner housing 31*b*, and pass through an opening of the relay substrate 32. The relay substrate 32 is attached to an end surface of the rear inner housing 31*b*. Positive and negative signals supplied from the core wire 33 are supplied to each of the circuit substrates via the relay substrate 32. The cover 34 for protection can be provided to the core wire 33.

Figure 12:
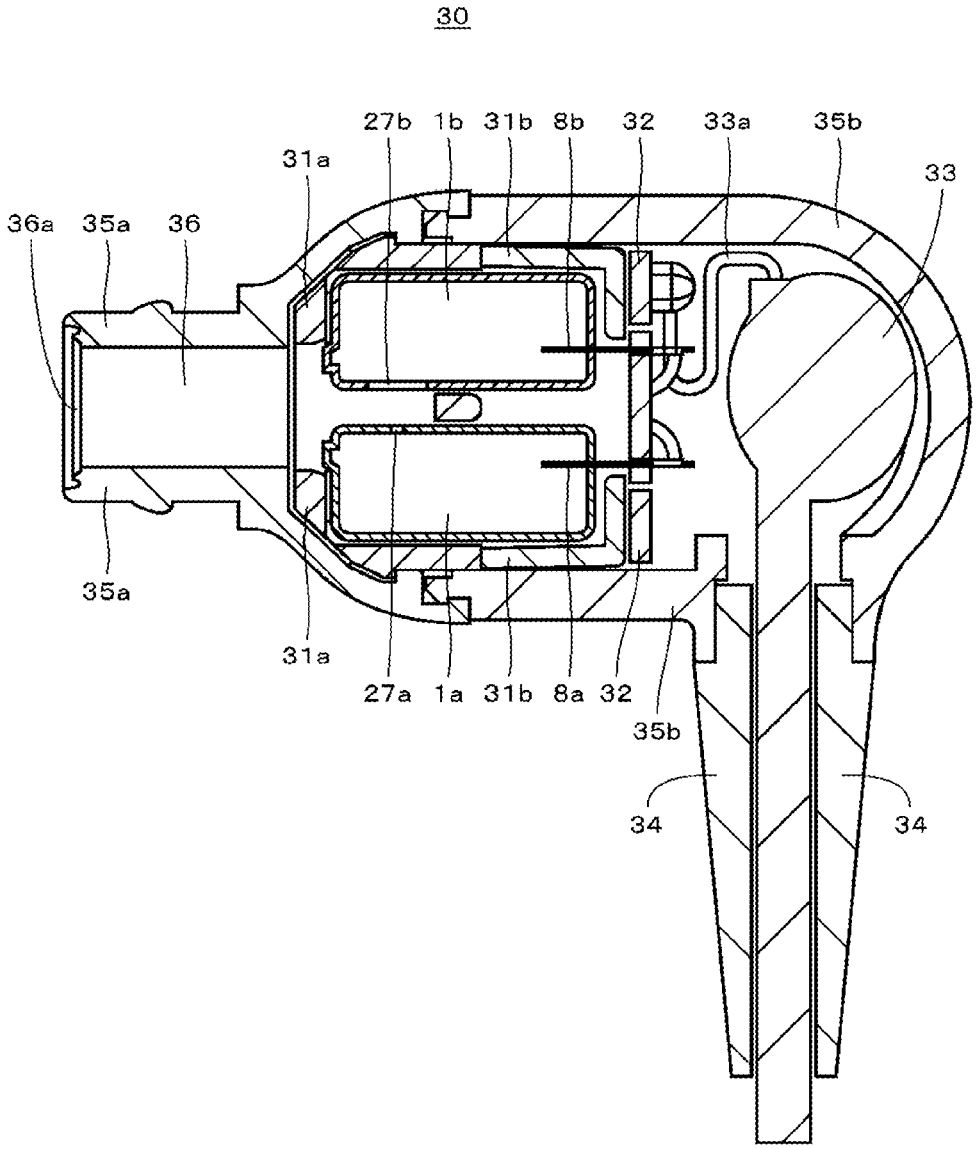
FIG. 12 is a cross-sectional view illustrating an example of a cross-section of the earphone device.

FIG. 12 shows an example of a cross-section of the earphone device 30. In FIG. 12, the drawing of the cross-section of the earpiece and the configuration inside the driver units 1*a* and 1*b* are properly omitted. The inner space is formed by the housing 35 which is formed of the front housing 35*a* and the rear housing 35*b*. The sound conductive tube 36 is formed in the front housing 35*a*, and a sound is output via a sound emission hole 36*a* at a tip of the sound conductive tube 36.

The front inner housing 31*a* is attached to an inner surface of the front housing 35*a*, and is fixed by adhesion. The driver units 1*a* and 1*b* are respectively inserted into the insertion openings formed by the front inner housing 31*a*. For example, the driver unit 1*a* is inserted into the insertion opening at the lower side in the drawing, and the driver unit 1*b* is inserted into the insertion opening at the upper side. At this time, for example, the driver units 1*a* and 1*b* are respectively inserted into the openings in such a way that the openings 27*a* and 27*b* face each other.

The rear inner housing 31*b* is combined with the front inner housing 31*a*. An inner surface of the rear inner housing 31*b* comes in contact with the driver units 1*a* and 1*b*. The driver units 1*a* and 1*b* are layered and supported by the front inner housing 31*a* and the rear inner housing 31*b*. A sound generated by the operation of the driver unit 1*a* is emitted from the opening 27*a*. A sound generated by the operation of the driver unit 1*b* is emitted from the opening 27*b*. The sounds emitted from the respective openings are synthesized inside the housing 35. The synthesized sound is emitted from the sound emission hole 36*a* of the sound conductive tube 36, whereby the sound is reproduced from the earphone device 30.

A part of the circuit substrate 8*a* led out of the driver unit 1*a* passes through the opening formed in the relay substrate 32. A predetermined position of the conductive pattern at a portion of the circuit substrate 8*a*, the portion having passed through the opening, is fixed to a predetermined portion of the relay substrate 32 by soldering, for example. A part of the circuit substrate 8*b* led out of the driver unit 1*b* passes through an opening formed in the relay substrate 32. A predetermined position of the conductive pattern at a portion of the circuit substrate 8*b*, the portion having passed through the opening, is fixed to a predetermined portion of the relay substrate 32 by soldering, for example.

Positive and negative signals are supplied to the relay substrate 32 via the cord 33*a* and the like of the core wire 33. The positive and negative signals are supplied to each of the circuit substrates 8*a* and 8*b* via the relay substrate 32. In the inner space formed by the housing 35, the vicinity of an end part of the core wire 33 is housed. The end part of the core wire 33 has a rounded shape, for example, and the cords 33*a* and 33*b* extend from the end part. The cords 33*a* and 33*b* are connected to predetermined positions of the relay substrate 32. The core wire 33 extends from the lower opening of the rear housing 35*b*. The cover 34 for protection is attached around the core wire 33, for example, and the core wire 33 passes through the interior of the cover 34.

[Frequency Characteristic of Sound]

Figure 13:
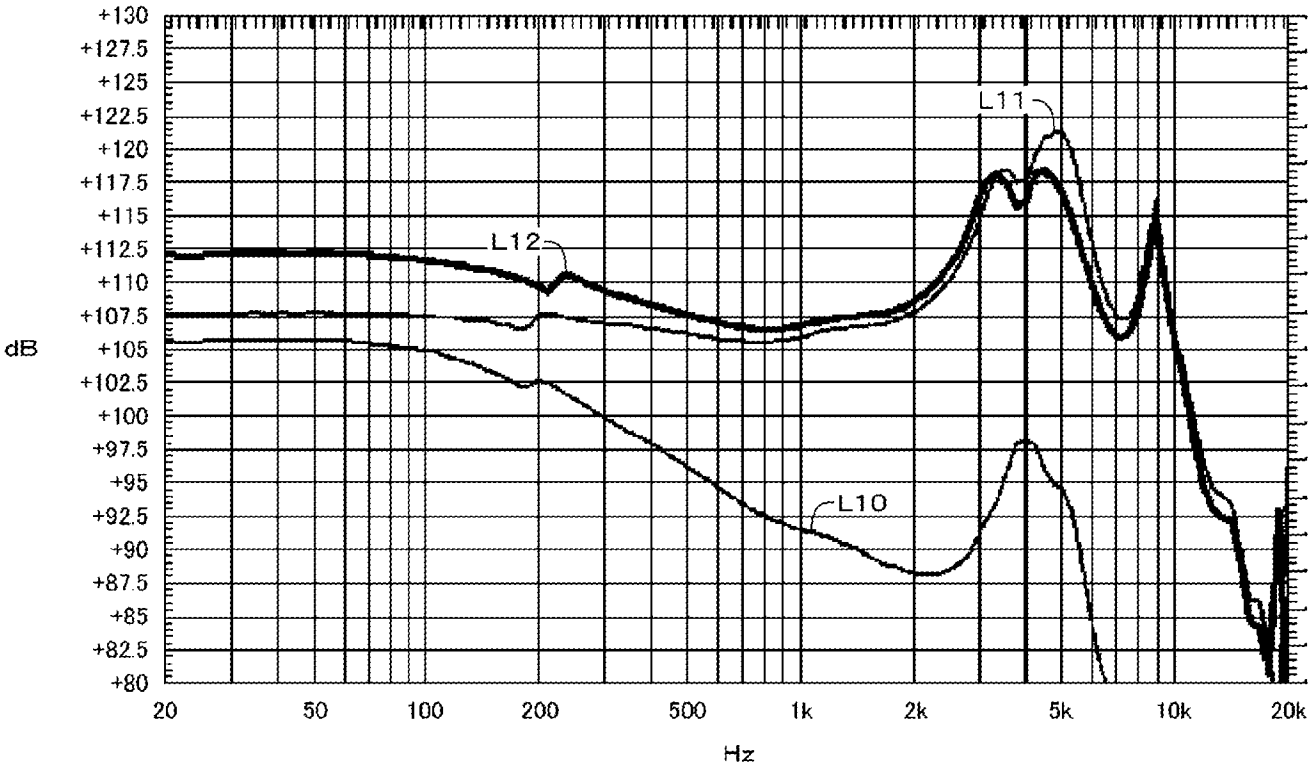
FIG. 13 is a diagram illustrating an example of a frequency characteristic of a sound emitted from the earphone device.

FIG. 13 shows an example of a frequency characteristic of a sound. A line L10 in the graph shows a frequency characteristic of a sound emitted from the opening 27*a* of the driver unit 1*a*. A line L11 shows a frequency characteristic of a sound emitted from the opening 27*b* of the driver unit 1*b*. A line L12 shown by bold line shows a frequency characteristic of a sound reproduced from the earphone device 30.

By synthesizing the sounds emitted from the opening 27*a*, the level of a low frequency range (for example, the range of 500 Hz or less) of the sound emitted from the earphone device 30 can be strengthened. In this way, in the earphone device according to the present disclosure, the low frequency range can be strengthened by simply setting the diameter of the opening formed in the driver unit properly. Therefore, the low frequency range can be strengthened without using the network, whereby the sound quality reproduced from the earphone device can be improved. Further, the earphone device can be downsized.

2. Modifications

As described above, a plurality of embodiments has been concretely described. However, various modifications are obviously possible. Hereinafter, the modifications will be described.

Figure 14:
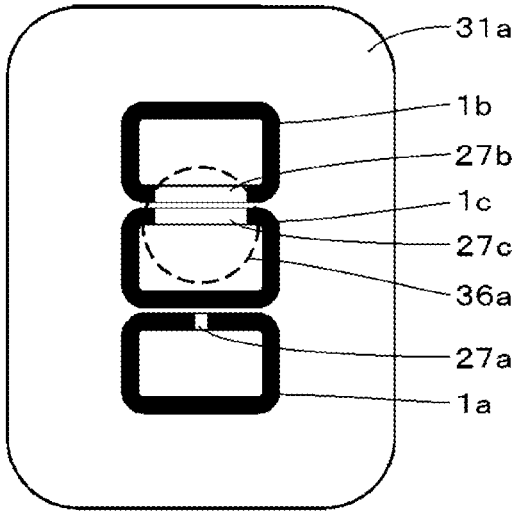
FIGS. 14A and 14B are schematic diagrams illustrating another exemplary arrangement of the driver unit.
Figure 14:
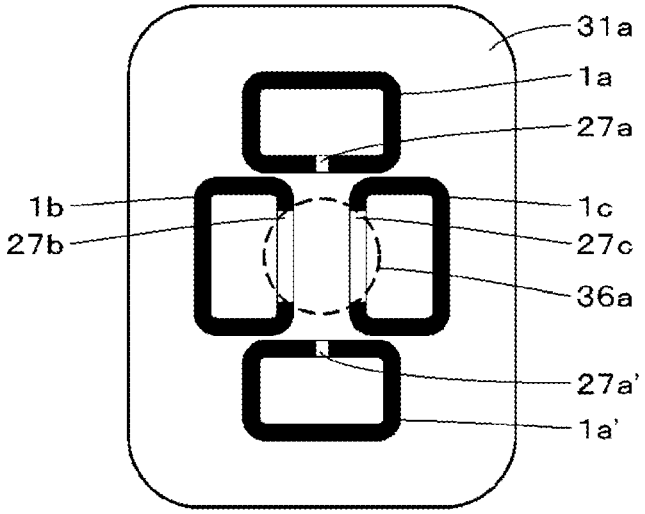

In the embodiments described above, an earphone device configured from two driver units (two-way) has been described. However, the earphone device can be configured from a multi-way system such as three-way or four-way. FIG. 14A shows an outline regarding an arrangement of driver units when the earphone device is configured from the three-way system.

At a front inner housing 31*a* in the modification shown in FIG. 14A, three insertion openings are formed. To the three insertion openings, a full-range driver unit 1*b*, a driver unit 1*c* for tweeter, and a driver unit 1*a* for woofer are inserted and supported in this order, for example. At this time, for example, an opening 27*b* of the driver unit 1*b* and an opening 27*c* of the driver unit 1*c* may be caused to face each other.

Sounds emitted from the openings 27*a*, 27*b*, and 27*c* are synthesized inside a housing 35. The synthesized sound is emitted from a sound emission hole 36*a* of a sound conductive tube 36. By further providing the driver unit 1*c* for tweeter, a sound whose high frequency range is strengthened can be reproduced from the earphone device.

FIG. 14B shows an outline regarding an arrangement of driver units when the earphone device is configured from the four-way system. At a front inner housing 31*a* of another modification shown in FIG. 14B, four insertion openings are formed. For example, at the front inner housing 31*a*, two insertion openings are formed in the up and down direction and two insertion openings are formed in the right and left direction.

With respect to the insertion openings in the up and down direction, a driver unit 1*a* for woofer and a driver unit 1*a*' for super woofer are respectively inserted and supported. With respect to the insertion openings in the right and left direction, a full-range driver unit 1*b* and a driver unit 1*c* for tweeter are respectively inserted and supported.

The driver unit 1*a*' has substantially the same configuration as the driver unit 1*a*, and an opening 27*a*' is formed in the driver unit 1*a*'. The diameter of an opening 27*a* of the driver unit 1*a* is 60 μm, for example, and the driver unit 1*a* functions as a driver unit for woofer. The diameter of the opening 27*a*' of the driver unit 1*a*' is 50 μm, for example, and the driver unit 1*a*' functions as a driver unit for super woofer.

The driver units 1*a* and 1*a*' are supported in such a way that the openings 27*a* and 27*a*' face each other. The driver units 1*b* and 1*c* are supported in such a way that the openings 27*b* and 27*c* face each other. A sound generated by the driver unit 1*a* is emitted from the opening 27*a*. A sound generated by the driver unit 1*a*' is emitted from the opening 27*a*'. A sound generated by the driver unit 1*b* is emitted from the opening 27*b*. A sound generated by the driver unit 1*c* is emitted from the opening 27*c*. The sounds emitted from the respective openings are synthesized inside a housing 35, and the synthesized sound is emitted from a sound emission hole 36*a* of a sound conductive tube 36. From the earphone device, a sound having a further strengthened low frequency range and improved sound quality is reproduced.

Figure 15:
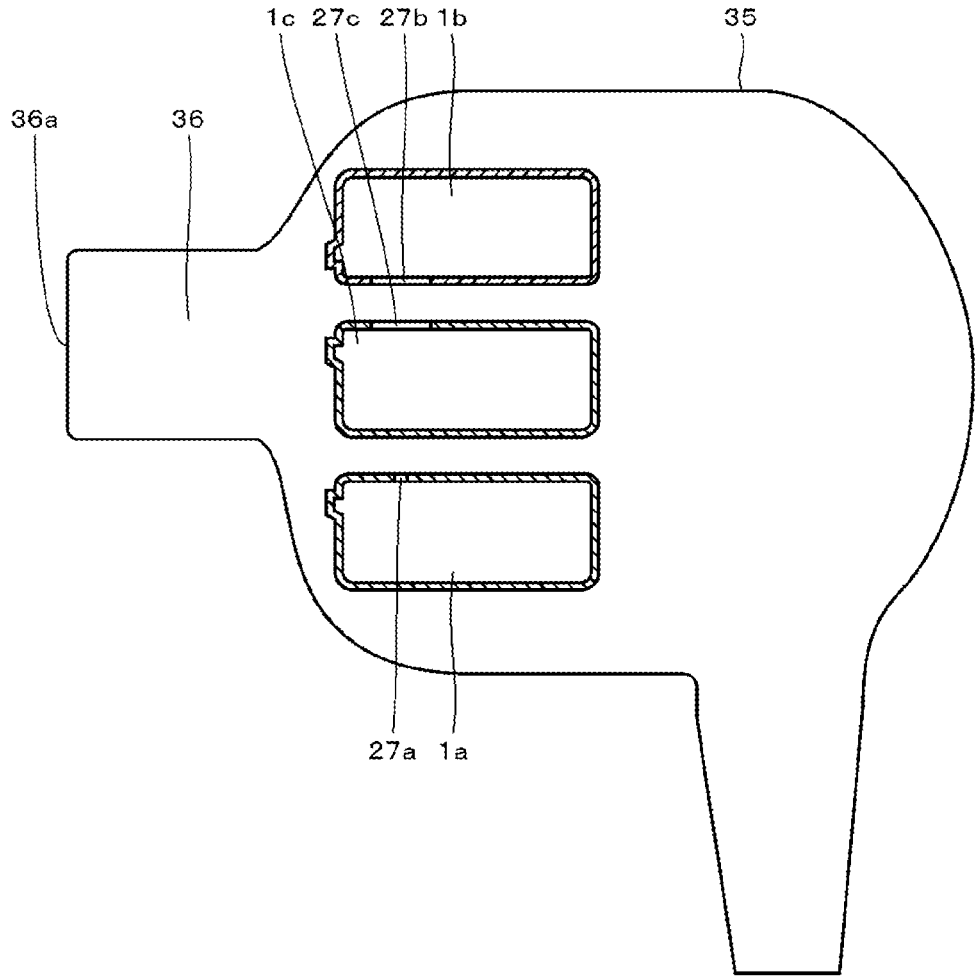
FIG. 15 is a schematic diagram illustrating another exemplary arrangement of the driver unit.

Note that, each driver unit can be supported in such a way that the distance from the sound emission hole 36*a* to the opening of the driver unit for woofer is maximized among the distances from the sound emission hole 36*a* to the respective openings of the driver units. As the outline is shown in FIG. 15, the distance from the center of the sound emission hole 36*a* to the center of the opening 27*a* can be, for example, larger than the distances from the center of the sound emission hole 36*a* to the centers of the openings 27*b* and 27*c*. In other words, a transmission distance of an emitted sound from the opening 27*a* to the sound emission hole 36*a* can be maximized.

A sound generated by the driver unit 1*a* passes through the opening 27*a* having high acoustic impedance. Therefore, attenuation of the sound which is caused during the sound being transmitted from the opening 27*a* to the sound emission hole 36*a* is small. On the other hand, sounds generated by the driver units 1*b* and 1*c* respectively pass through the openings 27*b* and 27*c* having low acoustic impedance. Therefore, the sounds having passed through the openings 27*b* and 27*c* are easily attenuated during the sound being transmitted from each of the openings to the sound emission hole 36*a*. When arranging a plurality of driver units, by causing the distance from the sound emission hole 36*a* to the opening 27*a* to be large, and causing the openings 27*b* and 27*c* to come close to the sound emission hole 36*a*, a sound having a strengthened low frequency range can be reproduced without attenuating middle and high frequency ranges.

Figure 16:
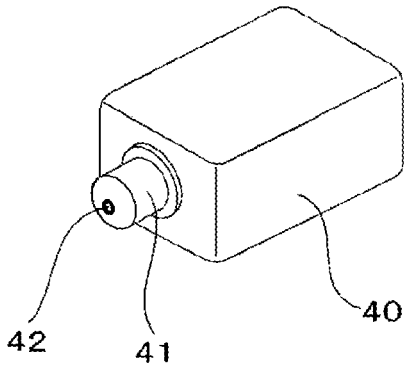
FIG. 16 is a schematic diagram illustrating another exemplary shape of the driver unit.

The housing body of the driver unit is not limited to the box shape. FIG. 16 shows an example of another shape of the housing body of the driver unit. The housing body of a driver unit 40 has a shape including a funnel-shaped member 41. A mesh film may be formed at a tip of the member 41, and an opening may be formed in the film. For example, at the tip of the member 41, an opening having a form identical to the openings 27*a* or 27*b* may be formed.

Whole or a part of the embodiments and modifications described above may be mutually combined insofar as they are within the scope of the appended claims or the equivalents thereof. The illustrated arrangements of materials and members may be properly altered without departing from the spirit or scope of the appended claims.

Additionally, the present disclosure may also be configured as below.

(1) A driver unit comprising:

an acoustic conversion unit; and a housing body in which the acoustic conversion unit is housed, and in which an opening is formed, wherein the acoustic conversion unit includes a pair of magnets arranged to face each other, a coil to which an input signal is supplied, an armature at which a vibrating part passing through the coil and arranged between the pair of magnets is formed, and a vibrating plate connected to the armature, and wherein a size of the opening is larger than 40 μm and smaller than 100 μm.

(2) An earphone device comprising:

at least two or more driver units being supported by a supporting part in an inner space formed by a housing, wherein each of the driver units includes an acoustic conversion unit, and a housing body in which the acoustic conversion unit is housed, and in which an opening is formed, wherein the acoustic conversion unit includes a pair of magnets arranged to face each other, a coil to which an electrical signal is supplied, an armature at which a vibrating part passing through the coil and arranged between the pair of magnets is formed, and a vibrating plate connected to the armature, and wherein a size of the opening of one of the driver units is larger than 40 μm and smaller than 100 μm.

(3) The earphone device according to (2), wherein the one driver unit and another driver unit are layered and supported, and wherein the size of the opening of the other driver unit is larger than the size of the opening of the one driver unit.

(4) The earphone device according to (2) or (3), wherein the opening of the one driver unit and the opening of the other driver unit are supported to face each other.

(5) The earphone device according to any one of (2) to (4), wherein a sound conductive part is formed by the housing, and wherein among distances from a tip end of the sound conductive part to the respective openings, the distance from the tip end of the sound conductive part to the opening of the one driver unit is the largest.

(6) The earphone device according to any one of (2) to (5), wherein each of the housing bodies of the driver units has approximately the same size.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2011-192687 filed in the Japan Patent Office on Sep. 5, 2011, the entire content of which is hereby incorporated —.

What is claimed is:

1. An earphone device comprising:

a first driver unit comprising:

a first acoustic conversion unit; and a first housing body to house the first acoustic conversion unit, wherein a first opening is formed in the first housing body to emit sound generated by the first acoustic conversion unit to a housing of the earphone device; and a second driver unit comprising:

a second acoustic conversion unit; and a second housing body to house the second acoustic conversion unit, wherein a second opening of diameter larger than the diameter of the first opening is formed in the second housing body to emit sound generated by the second acoustic conversion unit to the housing of the earphone device.

2. The earphone device of claim 1, wherein the diameter of the first opening is larger than 40 μm and smaller than 100 μm.

3. An earphone device comprising:

at least two driver units supported by a supporting part in an inner space formed by a housing of the earphone device, wherein each of the at least two driver units comprises:

an acoustic conversion unit, and a housing body to house the acoustic conversion unit, wherein an opening is formed in the housing body to emit sound generated by the acoustic conversion unit to the housing of the earphone device; and a sound conductive part, wherein sound emitted to the housing of the earphone device from the opening of each of the at least two driver units is output through the sound conductive part, wherein the diameter of the opening in the housing body of one of the at least two driver units is larger than the diameter of the opening in the housing body of the other driver unit.

4. The earphone device according to claim 2, wherein the at least two driver units are layered and supported.

5. The earphone device according to claim 3, wherein the opening in the housing body of one of the at least two driver units and the opening in the housing body of the other driver unit are supported to face each other.

6. The earphone device according to claim 3, wherein the sound conductive part is formed by the housing, and wherein among distances from a tip end of the sound conductive part to the opening in the housing body of each of the at least two driver units, the distance from the tip end of the sound conductive part to the opening in the housing body of one of the at least two driver units is larger.

7. The earphone device according to claim 3, wherein the housing body of each of the at least two driver units are of same size.

8. The earphone device according to claim 3, wherein the sound conductive part is formed by the housing and wherein sound emitted from the opening in the housing body of each of the at least two driver units to the housing of the earphone device enters the sound conductive part.

9. The earphone device of claim 3, wherein filtration of sound frequencies generated by the acoustic conversion units is based on the diameter of the opening in the housing body of each of the at least two driver units.

10. The earphone device of claim 3, wherein the acoustic conversion unit comprises:

a pair of magnets arranged to face each other;

a coil to which an electrical signal is supplied;

an armature at which a vibrating part passing through the coil and arranged between the pair of magnets is formed; and a vibrating plate connected to the armature.

11. The earphone device of claim 3, wherein diameter of the opening of one of the at least two driver units is larger than 40 μm and smaller than 100 μm.

* * * * *